United States Patent [19]

Daugherty

[11] 4,073,105

[45] Feb. 14, 1978

[54] TEMPORARY STRUCTURE

[76] Inventor: Charles R. Daugherty, 29284 Hoover, Warren, Mich. 48093

[21] Appl. No.: 502,172

[22] Filed: Aug. 30, 1974

Related U.S. Application Data

[63] Continuation-in-part of Ser. No. 310,597, Nov. 29, 1972, abandoned.

[51] Int. Cl.[2] ..... E04B 1/343; E04B 1/348

[52] U.S. Cl. ..... 52/169.9; 46/31; 52/71; 52/588; 52/589

[58] Field of Search ..... 52/70, 71, 90, 3, 4, 52/5, 522, 528, 588, 589, 590, 169.9; 46/30, 31; 16/172; 135/1 C, 3 B, 4 C

[56] References Cited

U.S. PATENT DOCUMENTS

| | | | |
|---|---|---|---|
| 38,547 | 5/1863 | Bickhart | 52/4 |
| 781,122 | 1/1905 | Baker | 52/71 X |
| 880,757 | 3/1908 | Rugg | 16/172 |
| 1,162,236 | 11/1915 | Hipolito | 16/172 |
| 2,057,942 | 10/1936 | Fay | 52/70 |
| 2,181,451 | 11/1939 | Dow | 52/589 |
| 2,776,521 | 1/1957 | Zimmerman | 46/30 |
| 2,918,996 | 12/1959 | Brown | 52/522 |
| 3,042,052 | 7/1962 | Des Rosier | 135/1 C |
| 3,070,234 | 12/1962 | Deitchman | 16/172 X |
| 3,127,962 | 4/1964 | James | 52/522 X |
| 3,333,376 | 8/1967 | Marsters | 52/588 X |
| 3,408,641 | 10/1968 | Healy | 16/172 X |

FOREIGN PATENT DOCUMENTS

| | | | |
|---|---|---|---|
| 1,523,932 | 3/1968 | France | 52/70 |
| 773,318 | 11/1934 | France | 46/31 |
| 1,213,833 | 4/1960 | France | 135/1 C |
| 1,459,966 | 5/1969 | Germany | 52/588 |
| 1,120,106 | 12/1961 | Germany | 52/522 |
| 255,976 | 1/1927 | Italy | 16/172 |
| 403,249 | 6/1966 | Switzerland | 52/588 |
| 2,582 of | 1909 | United Kingdom | 52/5 |
| 644,782 | 10/1950 | United Kingdom | 46/31 |
| 592,740 | 9/1947 | United Kingdom | 46/31 |

*Primary Examiner*—Leslie Braun
*Attorney, Agent, or Firm*—Arnold S. Weintraub

[57] ABSTRACT

A polygonally shaped panel or fabrication device having a depending curled locking means formed at at least one edge of the panel is disclosed herein. The locking means is contiguious to and substantially co-extensive with the edge associated therewith. The curled locking means may include a plurality of apertures randomly distributed about the circumference thereof. A plurality of the present panels are deployed to form an interlocking and interconnecting system in a free form array which can be used as a toy construction, as a display system and, preferably, in the fabrication of modular structures.

5 Claims, 9 Drawing Figures

TEMPORARY STRUCTURE

CROSS-REFERENCE TO RELATED APPLICATION

This application is a continuation-in-part application of copending United States Patent Application Ser. No. 310,597, filed Nov. 29, 1972 for "Fabrication Devices", now abandoned.

BACKGROUND OF THE INVENTION

1. Field of the Invention

The present invention pertains to fabrication devices, and more particularly to polygonally shaped fabrication devices. More particularly, the present invention pertains to polygonally shaped fabrication devices having means for interconnecting a plurality of such devices. Even more particularly, the present invention concerns polygonally shaped fabrication devices having means for interconnecting same which are eminently useful in the formation of modular-type structures.

2. Prior Art

In the above-identified referred to copending application, the disclosure of which is hereby incorporated by reference, there is taught certain fabrication devices which provide free form arrangements through the use of integrally formed interlocking means. Such devices or panels, while being extremely practical for the therewithin considered utilities, have now been discovered as being eminently useful for the fabrication of temporary, modular structures or shells.

There often exists the need for inhabitable structures on a temporary basis, such as, cabanas, tents, outdoor bathrooms and the like. Ordinarily, such structures are fabricated from canvas and the like. As is well known, such temporary structures are bulky, weighty and cumbersome to erect and store. Furthermore, such temporary structures are inherently frail and do not withstand high winds and other inclement climatic conditions. These inherent drawbacks are overcome by the present invention.

SUMMARY OF THE INVENTION

In accordance with the present invention, there is provided a polygonally shaped fabrication device or panel having a substantially planar surface. At each edge of the planar surface is formed a depending curled locking means. The curled locking means is contiguous to and substantially co-extensive with the edge of the planar surface at which it is formed.

Each of the locking means of any one of the panels is adapted to interconnect with any other locking means formed on any other panel which may be provided. Thus, a system of interconnected panels can be formed herefrom.

The interconnection of the panels through the locking means is achieved by inserting one of such locking means within the other at any desired point therealong.

The present invention further contemplates the inclusion of means, such as a nub or the like, formed on the locking means, which obviates any possibility of rotational or translational movement between the locking means which might, otherwise, disturb the stability of the interlocked device.

Further, it is contemplated in an alternative embodiment, that the radius of curvature at the ends of the curled locking means be larger than at the central or medial portion thereof. Thus, in effect, a bulge is formed. Thus, again, obviates the possibility of rotational or translatory movement between the panels.

The panels hereof, when interconnected, form a temporary structure which is easily stored and constructed. The panels hereof form a stable structure when interconnected.

The panels hereof can be manufactured with doors, windows or the like to enhance the aesthetic appeal and to increase the utility of the panels depending on their application.

The panels hereof are, preferably, molded from a rigid plastic, such as a polyurethane, polyethylene, hexamethylene adapamide or the like.

For a more comprehensive and complete understanding of the instant invention, reference is made to the following detailed description and accompanying drawing. In the accompanying drawing, like reference characters refer to like parts throughout the several views in which:

DESCRIPTION OF THE PREFERRED EMBODIMENTS

Figure 4:
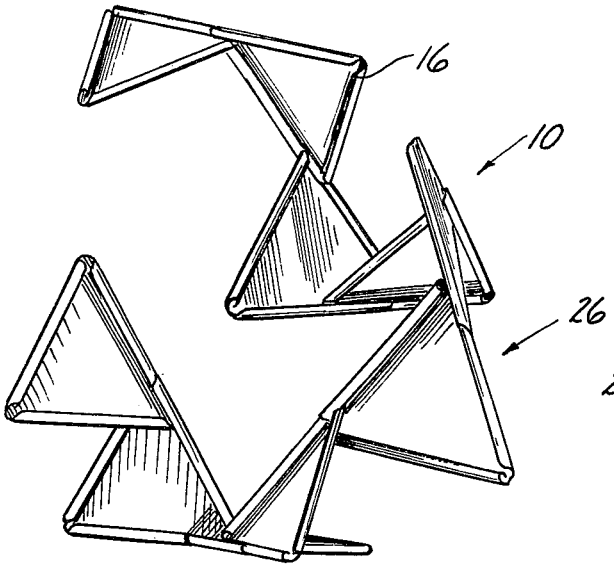
FIG. 4 is a perspective view showing a plurality of interlocked panels.

At the outset, and with reference to FIGS. 1-6 of the drawing, it is to be understood that in accordance with the present invention, although a triangular shaped panel is illustrated in the drawing, the invention is not solely limited thereto. Rather, the triangular shaped panel is depicted to facilitate a complete understanding of the present invention, although, any geometric shaped can be utilized.

Figure 1:
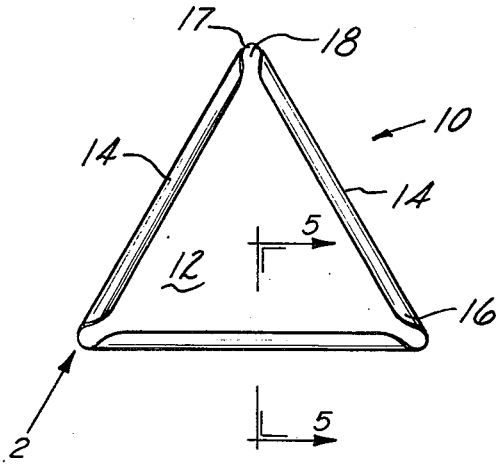
FIG. 1 is a side elevational view of a panel of the instant invention.
Figure 2:
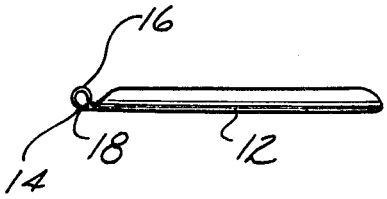
FIG. 2 is a view taken along the line of sight 2 of FIG. 1.

Now with reference to the drawing and in particular FIGS. 1 and 2, there is depicted therein a first embodiment of the instant invention generally indicated at 10. The invention comprises a polygonally shaped fabrication device or panel 10 having a substantially flat planar surface 12. Depending from at least one edge 14 of the planar surface 12 is a curled locking means 16. The locking means or interconnecting member 16 is contiguous to the edge 14 and is substantially co-extensive therewith. Moreover, as shown in FIG. 2, the locking means 16 is integrally formed with or otherwise curled directly from the edge 14 of the surface 12 so that the plane of the surface 12 is not disrupted. This is essential to the instant invention since it facilitates the assembly of a free form array herefrom.

Where more than one curled locking means 16 is deployed on any one particular panel, the radius of curvature imparted to each curled locking means is substantially equal. Thus, the most outward or tangential lines to the circumference of the curled locking means 16 define a plane substantially parallel to that of the planar surface 12 of the panel or member 10.

As hereinbefore noted, the curled locking means 16 are substantially co-extensive with the edge 14 associated therewith. However, the curled locking means 16 is not exactly equal in length to facilitate interlocking, as is explained subsequently.

Still referring to FIGS. 1 and 2, assuming at least two curled locking means on any one panel 10, it can be seen that the apex or intersection 17 of any two edges 14 is open such as at 18. The configuration of the opening 18 is generally a cycloid, elipsoid or the like (FIG. 2). This depends upon the curvature imparted to the templet or form 20 (FIG. 3) from which the panel or device 10 is prepared when the panel is manufactured from a metal. Alternatively, when the panels are made from a molded plastic the shape of the opening 18 is dictated by the configuration of the mold used to manufacture the panel. The degree of opening is dictated by the longitudinal length of the locking means 16, and is generally a function of the circumference of the locking means. It is critical, though, that the opening 18 be provided.

Figure 3:
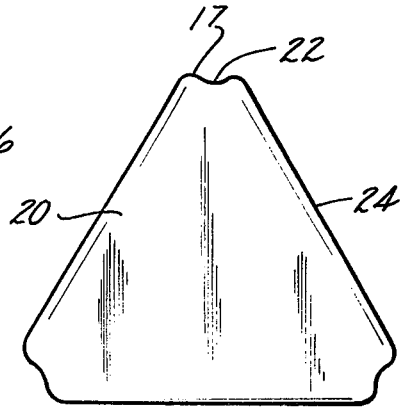
FIG. 3 is a side elevational view of the form from which the instant panels are manufactured.

Referring now to FIG. 3, the instant device 10 when fabricated from a metal, such as, tin, aluminum, or the like, are generally manufactured from a substantially flat planar form or templet 20 accorded the desired polygonal shape. However, the intersection, or apex 17 on any two adjacent edges is provided with a sinusoidal curvalinear connection 22 therebetween. This facilitates formation of the opening 18 as well as providing a smooth edge to the device to prevent possible injury, through cuts or the like, to the user. The edge 24 of the templet 20 is curled by stamping progressive die-forming or other suitable means to form the depending curled locking means 16.

Otherwise, the devices 10 can be directly molded from any suitable plastic, such as, polyethylene, hexamethylene adipamide, polyurethane and the like, under conventional rigid molding conditions.

Figure 5:
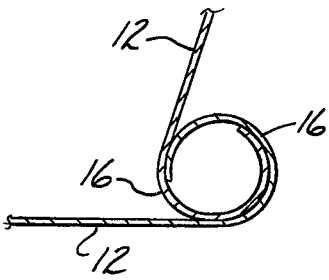
FIG. 5 is a sectional view along the line 5—5 of FIG. 1.

In deploying the instant devices, and as depicted in FIGS. 4 and 5, a constructional array or system 26 is erected by interconnecting the panels through the curled locking means 16. The interconnectability is facilitated by the heretofore referred to openings 18 provided at the apices or intersections 17 of the edges 14 of the panels 10 from which the curled locking means 16 depend.

To interconnect any two panels, all that is required is the linear translation of any one panel 10 with respect to the other. Thus, any locking means on any one panel is insertable through an opening 18 into and within the corresponding locking means 16 provided on the other panel as shown in FIG. 5. The degree of superimposition or insertion or receipt of any one locking means within the other can be varied at any point along the longitudinal axis respective to both interlocking means. This affords any random construction or free form array sought to be assembled. Because of the substantial equality of the radius of curvature of the locking means, the frictional forces therebetween maintain the stability of the system 26.

Figure 6:
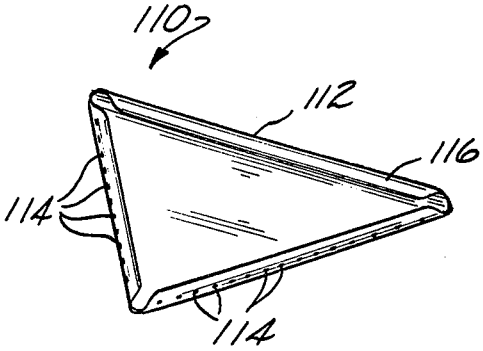
FIG. 6 is a perspective view of an alternate embodiment of the present invention.

In an alternate embodiment, depicted in FIG. 6, the device 110 has its curled locking means 112 provided with a plurality of apertures 114 disposed therealong in random circumferential disposition. The apertures 114 are employed in those instances where the panel 110 is used in assembling a free form display system as hereinafter described.

In a further embodiment of the present invention, and as shown, also, in FIG. 6, the curled locking means 112 is provided with at least one nub 116 formed thereon. The nub is employed to prevent any rotational or translatory movement of interconnected panels, where the possibility of such movement exists. This is a safety factor which prevents the collapse of any system constructed from the use of a plurality of the instant panels.

It is further contemplated by the present invention, although not shown, that in lieu of the nub 116, the radius of curvature imparted to any one locking means is variable along the longitudinal axis thereof. By varying the radius of curvature, a more snug frictional engagement is effectuated between any two interconnected locking means. This, again imparts further stability to the system to inhibit any rotational or translatory motion which would collapse a system constructed from a plurality of panels. However, in most instances, these herein described further means for preventing and inhibiting rotational or translatory motion are not necessary.

It should be noted that the devices of the instant invention are not restricted to any one particular size, thus permitting a variety of utilities. Thus, it is contemplated that when the panels are manufactured in a large size, display systems, construction units or the like, can be assembled. In such instances, posters or the like (not shown) can be affixed to any planar surface and be secured thereto through suitable means.

The apertures 116 provided along the circumference of the locking means generally comprise punchings wherein the metal punched out acts as a friction force to prevent motion of interlocked panels. Furthermore, by coincidence of apertures from two interlocked panels, a securing means (not shown) such as, a pin, can be inserted therethrough.

On a smaller scale, the polygonally shaped panels can be used as a toy construction kit, educational device or the like.

It is to be further understood in the practice of the present invention that although the curled locking means have all been shown as depending in one direction from the planar surface the present invention is not so restricted. A random direction of the curl, i.e., downward, vertical or mixed (FIG. 1) can be accorded any one panel where a plurality of curled locking means are integrally formed therewith.

Figure 7:
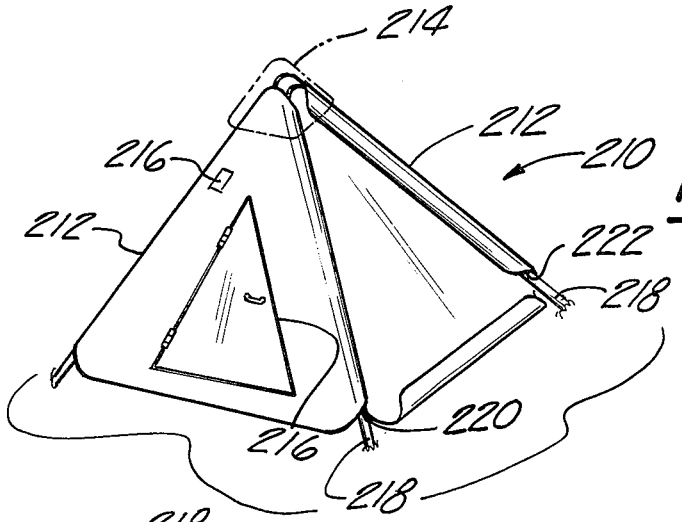
FIG. 7 depicts a temporary structure formed from the panels hereof.
Figure 8:
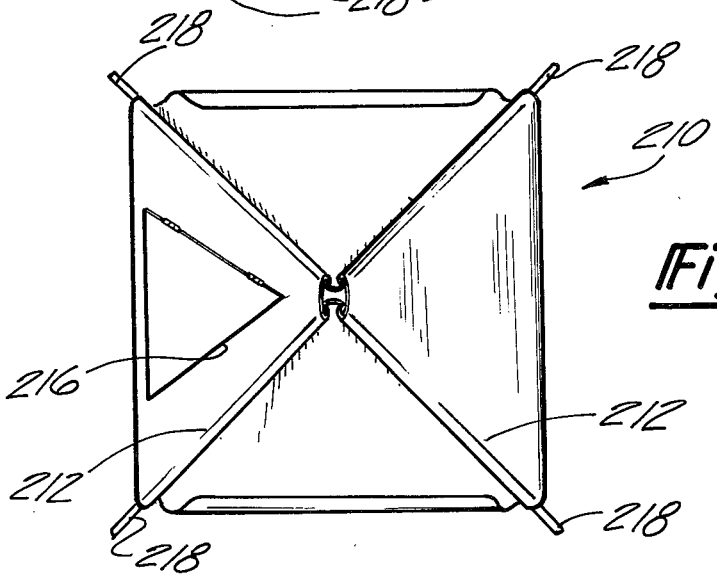
FIG. 8 is a top plan view of the structure of FIG. 7.

Referring now to FIGS. 7–8, there is depicted therein a further embodiment of the present invention as defined herein and in accordance herewith.

According to the embodiment defined in FIGS. 7–8, there is provided a temporary inhabitance or structure, generally indicated at 210. The structure is provided by forming a plurality of devices 212 in a triangular configuration. The triangular panels define side walls for the structure. A cap member 214 defines a roofing or top wall to enclose the temporary structure.

Furthermore, and in accordance herewith, the panels 112 can be fabricated with openings 216 to define windows, doors and the like.

In utilizing the present invention in constructing a temporary structure a plurality of ground pegs 218 are optionally deployed. The pegs obviate the possibility of collapse of the structure during incliment climatic conditions. The pegs have their free ends 220 inserted into the void 222 defined by the space interior of the locking means of the interior panel.

It is to be noted that in forming such structures, the side walls will normally have $n-1$ curled locking means wherein $n$ is the number of edges of the panel. The other edge, without the locking means will be ground engaging. Alternatively, rather than forming the device with $n-1$ curled locking means, a bottom wall can be utilized which at the same time eliminate the need for a ground cover.

In this embodiment of the invention, the devices or panels are, preferably, molded from any suitable synthetic plastic resin. Suitable resinous compositions include polyethylene, hexamethylene adipamide (nylon), polyurethane and the like. Molding can be achieved by any suitable means amenable to the composition.

In forming the structures hereof the devices are interlocked and interconnected in the manner heretofore described.

Figure 9:
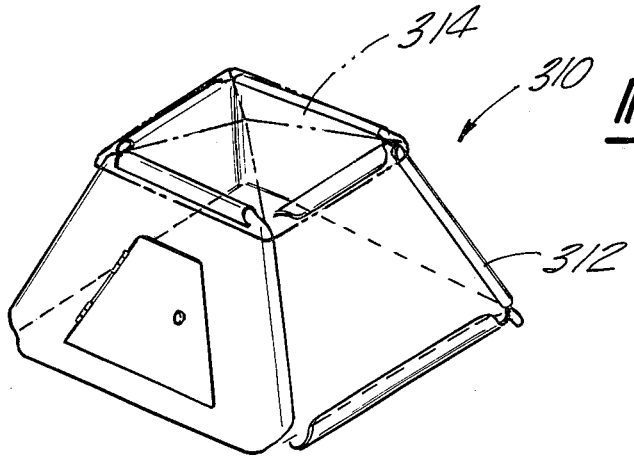
FIG. 9 shows still another type of temporary structure.

In FIG. 9, there is shown an alternate embodiment 310 wherein the sidewalls 312 are trapezoidal. In this embodiment a rectangular panel 314 defines a roofing or top wall to enclose the structure. By providing a trapezoidal configuration greater interior living area is provided. As with the embodiment of FIGS. 7 and 8, openings for doors, windows and the like can be provided as well as a bottom wall. Additionally, ground pegs can be employed to reinforce the stability of the structure.

Having thus described the invention, what is claimed is:

1. A temporary structure comprising:

a. a plurality of interconnected sidewalls defining an enclosure, each of the sidewalls comprising:

1. a polygonally shaped member having a substantially flat planar surface, and N edges; and
2. curled locking means integrally formed with the flat planar surface at at least N−1 edges thereof, the curled locking means being contiguous to and substantially co-extensive with the edge associated therewith, an opening being provided at the intersection of any two adjacent edges of the flat planar surface to provide means for the linear translation of any one locking means into any one locking means of another sidewall, to thereby render the locking means receivable within any other locking means, and wherein the curled locking means are formed at the edge of the planar surface such that the plane thereof is uninterrupted;

b. a top wall interconnected to each of the sidewalls, the top wall comprising:

1. a polygonally shaped member having a substantially flat planar surface and configured the same as the enclosure defined by the sidewalls, and
2. curled locking means integrally formed with the flat planar surface at each edge thereof, the curled locking means being contiguous to and substantially coextensive with the edge associated therewith, the member having an opening at the intersection of any two adjacent edges of the flat planar surface to provide means for the linear translation of any one locking means thereof into any one locking means of a sidewall, the curled locking means being formed at the edge of the planar surface such that the plane thereof is uninterrupted; and c. at least one ground peg having one end insertable into a ground surface and the other end being insertable into the interior space defined by any two interlocked curled locking means; and wherein the locking means of any one sidewall is received within the locking means of the adjacent sidewall and the locking means of the top wall adjacent thereto to interlock the sidewalls and the top wall.

2. The structure of claim 1 wherein the sidewalls have $n$ locking means and which further includes a bottom wall, the bottom wall comprising: (a) a polygonally shaped flat planar surface having a configuration the same as the enclosure defined by the sidewalls, and (b) curled locking means integrally formed with the flat planar surface and being contiguous to and substantially co-extensive therewith, and wherein the locking means are receivable within the locking means adjacent thereto provided on each of the sidewalls.

3. The structure of claim 2 wherein the sidewalls are trapezoidal and the top wall and bottom wall are rectangular.

4. The structure of claim 1 wherein the sidewalls are trapezoidal and the top wall is rectangular.

5. The structure of claim 1 including means for egress and ingress from the interior of the structure.

* * * * *